US005393163A

United States Patent [19]

Wolf

[11] Patent Number: 5,393,163

[45] Date of Patent: Feb. 28, 1995

[54] LATTICE COMPRISING RODS AND JOINTS AND THE MANUFACTURE THEREOF

[76] Inventor: Elmar Wolf, Am Judengarten, D-8706 Hochberg, Germany

[21] Appl. No.: 780,436

[22] Filed: Oct. 15, 1991

Related U.S. Application Data

[63] Continuation of Ser. No. 533,296, Jun. 5, 1990, abandoned, which is a continuation of Ser. No. 246,420, Sep. 19, 1988, abandoned.

[30] Foreign Application Priority Data

Sep. 17, 1987 [DE] Germany ..... 3731184

[51] Int. Cl.[6] ..... F16S 3/00; E04B 1/00

[52] U.S. Cl. ..... 403/171; 403/170; 403/217

[58] Field of Search ..... 403/171, 170, 176, 217, 403/405; 446/120, 106, 116, 126

[56] References Cited

U.S. PATENT DOCUMENTS

| | | | |
|---|---|---|---|
| 3,356,394 | 12/1967 | Chamayou | 403/405 X |
| 3,550,311 | 12/1970 | Fouquart | 446/120 |
| 4,054,393 | 10/1977 | Talleri | 403/174 |
| 4,352,255 | 10/1982 | Warehime | 403/234 X |
| 4,548,590 | 10/1985 | Green | 446/120 |
| 4,565,383 | 1/1986 | Isaac | 403/174 X |
| 4,758,196 | 7/1988 | Wang | 403/171 X |
| 4,922,669 | 5/1990 | De Pas et al. | 403/171 X |

FOREIGN PATENT DOCUMENTS

| | | | |
|---|---|---|---|
| 2303578 | 10/1976 | France | 446/120 |
| 0618871 | 3/1961 | Italy | 446/120 |

*Primary Examiner*—Randolph A. Reese
*Assistant Examiner*—Anthony Knight
*Attorney, Agent, or Firm*—Edwin D. Schindler

[57] ABSTRACT

A lattice is disclosed which is made of a multiplicity of rods that are connected to one another by a series of joints. Each rod has a connecting member which serves to connect with the joint. The connecting member may be designed as a fork, the axis of which extends vertically to that of the rod. The lattice may be locked together by either a cam or by a spring clip. The resulting hollow body may be either a two- or three-dimensional object.

3 Claims, 2 Drawing Sheets

LATTICE COMPRISING RODS AND JOINTS AND THE MANUFACTURE THEREOF

Figure 1:
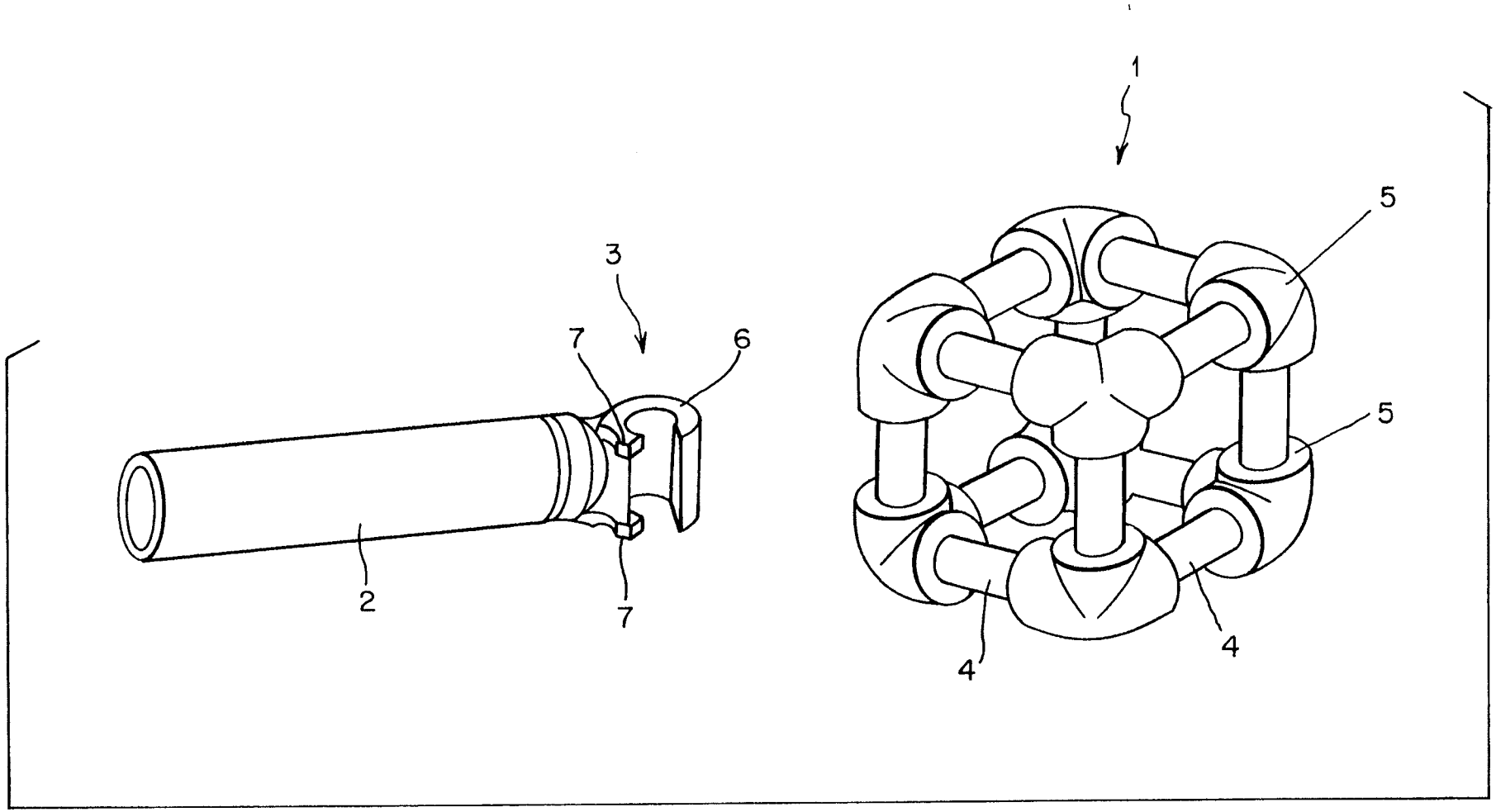

This application is a continuation of application Ser. No. 07/533,296, filed Jun. 5, 1990, now abandoned, which, in turn, is a continuation of application Ser. No. 07/246,420, filed Sep. 19, 1988, now abandoned.

The invention concerns a lattice made of rods, which are connected together by joints, each rod having at its ends a connecting member serving to connect with said joint, and a process for the manufacture of said joint.

These kind of lattices are generally known in the state of the art in the form of three-dimensional frameworks. They are constructed of rods, on the ends of which are disposed connecting members for fastening to said joints. The joints themselves are either round or of polygonal shape, whereby the fastening to partial areas is done by means of clip, plug, or screw connections. It is also known to form the joints as cubes whose edges serve to receive a clip connection.

All known lattices have in common that the connection is always rigidly formed, so that the angle of connection between rod and joint takes on a definite, predetermined value. Therefore it is to be regarded as disadvantageous that for an alteration of said angle of connection a fundamentally new design is necessary, especially of the joints, and that it is impossible subsequently to alter the angle of connection of said lattice. For certain fields of application of this kind of construction, e.g. trade fair erection, rapid connection and dismantling of these lattices is required, which, disadvantageously, with known constructions leaves a lot to be desired.

On this basis, it is the object of this invention to improve these kind of lattices, so that the angle of connection between said rod and joint is adjustable, and that assembly can be carried out substantially more quickly.

The task is solved with the aid of two measures, proposed independently of one another by this invention, namely the design of the connecting members and, independently thereof, that of the joint. It is naturally conceivable and possible, and thus not excluded, that both proposals be implemented simultaneously and jointly in one and the same lattice.

With regard to the connecting member fastened to the rod, it is proposed in accordance with this invention that it should be of fork shape and so fastened that its axis extends perpendicular to the rod, so that the plane enclosed by the two shanks of the fork comes to lie in the direction defined by the rod. The connecting member is fitted to the joint by movement of the rod in a radial direction, whereby the two shanks of the fork grasp a corresponding round pin, stud, or similar means. Fixing is achieved by means of a resiliently mounted cam disposed on the inside of that shank of the fork that faces the rod. As said rod is inserted, said cam is pushed aside and returns again to its original position once the end position is reached, in this way the connecting member is locked into position. The disposition on the shank facing the rod still allows said connecting member and rod to be loaded with the same degree of tension and pressure as before, since the cam causes no reduction in the maximum amount of transmissible force. Tensile load causes the opposite fork-shank to be loaded, and compressive load is transmitted without problem through the connecting member, joint and rod. The tensile and compressive loading of the rod are fully retained by the arrangement of the joint in the proposed manner. Shape and cross-section of the rod are, hereby, fundamentally irrelevant, however, a large contact area, i.e. a circular-shaped rim, is the most favorable. The same applies for the design of the cam. It is merely necessary that pin or stud, for the purpose of sliding in the rod, is chosen with the same or smaller external diameter than the clear width of the fork. For this, the use of a joint as proposed in accordance with this invention is not absolutely necessary.

In an alternative manner of fastening the connecting member, the use of a spring clip is proposed in place of the cam for locking into position. Said spring clip can be inserted from outside between both shanks of the fork and fixed there. For this, the inside of the fork is of a shape complementary to said spring clip. After insertion, the spring clip serves to lock the rod-shaped edge, which is to be received by the fork. During assembly the fork is put on first of all and subsequently the spring clip pushed in between the shanks as far as it will go, and fixed in that position. The connection is released in the reverse order. The spring clip is removed and the fork taken off. The advantage here being that the tensile and compressive loading of the rod are transmitted fully through the forks and are not determined by the spring clip itself, and thus limited. The load-bearing capacity is fully maintained.

The advantage of using the connecting member according to this invention lies in the fact that the choice of angle between rod and joint is principally optional, so that lattices with different and/or changeable constructional heights can be produced merely by changing the angle of connection of one and the same joint. Moreover, arched constructions can be erected, however, with different length rods as diagonals.

In addition, assembly requires very little effort to, as no screwing together or lengthy fixing work is to be done at the joint. Fastening is done by pressing on of said connecting member, or by moving said rod in a radial direction, and the connection released by applying a corresponding force in the opposite direction. Possibly the fork might have to be opened or closed by means of the spring clip.

A further development foresees disposing the connecting member endways on the rod and fastening it thereby.

Finally it is preferred to manufacture cam and fork as one piece, i.e. from one single part.

A different solution, fully independent of that previously described, comprises designing the joint as a two or three-dimensional hollow body, on the round edges of which said connecting member can be fastened. Accordingly the joint is formed by rods with round cross-sections, which form the lateral edges of the two or three-dimensional construction and which are connected to one another by the corners. With the help of the round cross-sections of the edges, every conceivable angle of connection is realizable. The shape of the hollow body formed by the joints is in principle optional, however, it may especially be a cubic, cuboidal, tetrahedral or planar construction.

Besides said connecting members, rods are employable that enclose and grasp the edges in a claw or scissor-like manner, and are locked there. The decisive advantage of such a construction lies in the fact that the angle of connection of one and the same joint can be variably and in the end optionally chosen. By changing the angle it is possible subsequently to change the constructional height of lattices without difficulty. In contrast to many other kinds of connections, as example one need only quote the screw clamp connections, the effort needed for assembly is comparatively small.

In a suitable embodiment, it is proposed that the corners connecting the edges should have the same external diameter as the connecting members. When installed, the corners and connecting members form smooth transitions. A further advantage is that the connecting piece produces, when installed and laterally flanked by the corners, an additional stability and a lateral support against displacement towards the edges.

Due to principle considerations the above-described joints and connecting members can be employed and used independently of one another. Particular attention is drawn to the fact that it is naturally conceivable and possible to use joints and connecting members in accordance with this invention together and simultaneously, and that this is especially recommendable. The simultaneous utilization of the two parts that are employable independently of each other forms the gist of the present invention.

The field of application of the proposed lattice is universal and covers beside frameworks, joint rods, supports, single-layer structures and also principally all constructional elements used in the manufacture of lattice structures made of rods and joints.

Concerning the joint, it is proposed by this invention to use an especially advantageous manufacturing procedure, wherein said joint comprises two identical halves, which are intermittently connected together. It is the case with three-dimensional joints that the joint can not be manufactured in its final shape, as in this case it would not be possible to remove it from the mould. The proposal to manufacture two identical parts allows on the one hand demoulding and on the other hand means it is only necessary to manufacture a single mould. However, it is necessary to connect both halves together in an additional work operation. This can be carried out by means of cold welding or ultrasonic welding.

Further details, features and advantages of the invention can be found in the following descriptive part, in which with the aid of drawings, typical embodiments of the invention will be explained in greater detail.

The figures show:

FIG. 1 a joint with a rod which can be fixed using cams.

Figure 2:
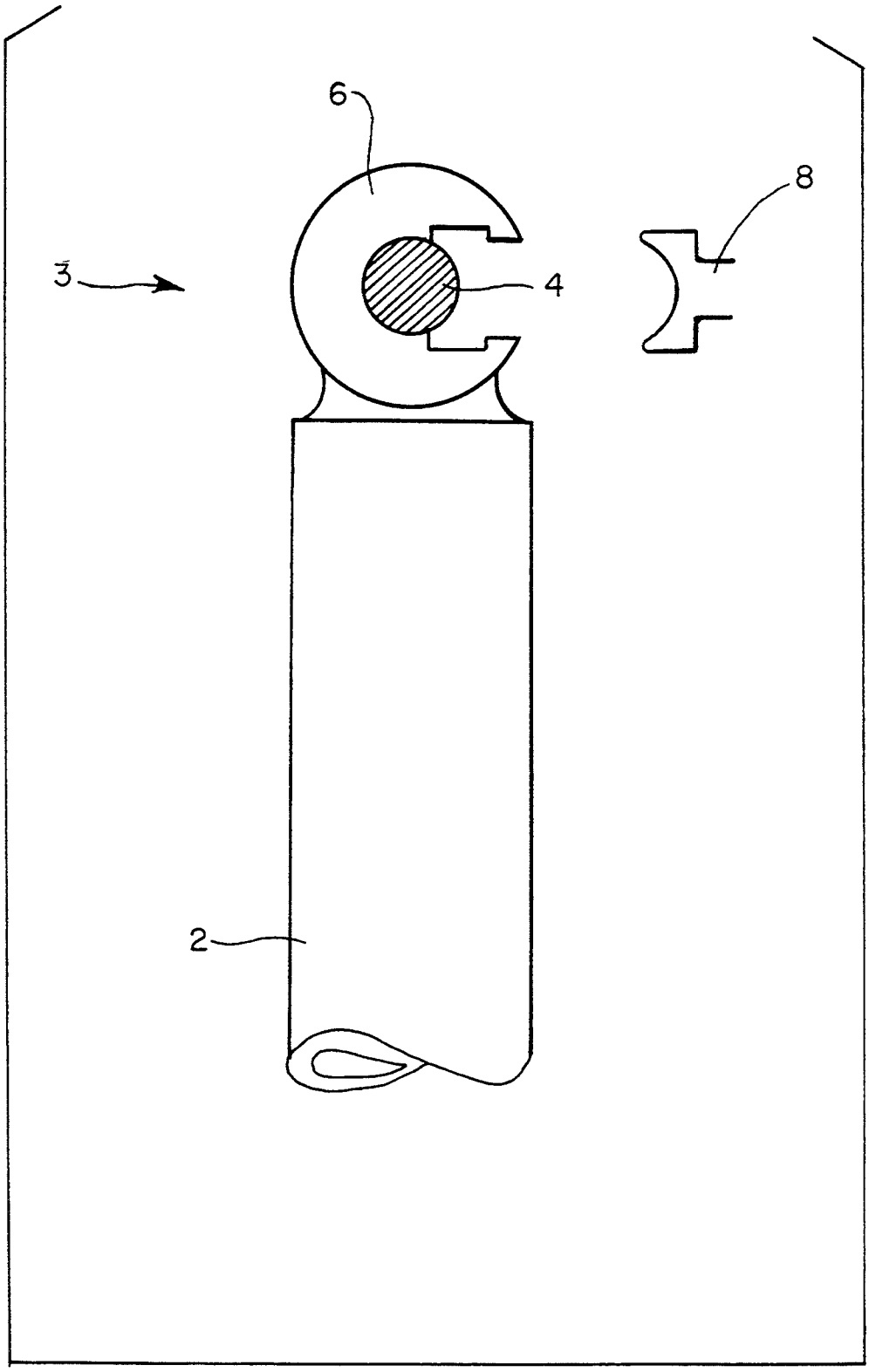

FIG. 2 a rod with spring clip.

In FIG. 1, a joint 1 and a rod 2 with connecting member 3, also formed according to this invention, fastened thereupon are shown in perspective view, in a suitable position for mutual interlocking.

Joint 1 will be explained first. It is of the form of a cube and therefore has twelve edges 4 with round cross-section, which are connected together externally via rounded corners 5.

The rod 2 that is to be fastened thereto has a connecting member 3 that is shaped in the form of a fork 6, the axis of which extends vertically to that of said rod 2. As locking means, two cams 7 are resiliently mounted on the side of that shank of said fork 6 that faces said rod, which, after being pushed onto and surrounding said edge 4, ensure fixing and locking. Assembly can thus be carried out by a simple pressing action.

To permit mounting of said connecting member 3 onto edge 4, the clear width of the fork 6 must be chosen the same as or (somewhat) greater than the external diameter of said edge 4, and the length of the connecting member 3 measured vertically to the axis of the rod be the same or slightly less that the distance between adjacent corners 5. Connecting member 3 is fixed on the face side of rod 2, partly interlocking with this. The drawing shows only a single rod 2 with connecting element 3 relative to joint 1. However, in the general case, a multiplicity up to a maximum of twelve connecting members 3 and consequently the rods 2 fastened thereupon may be fastened to one and the same joint 1.

FIG. 2 largely corresponds to the rod 2 shown in FIG. 1 with respect to connection 3 and fork 6, with the crucial difference, however, that, in place of the cam, a spring clip 8 is drawn, which, after placement of the fork 6 on the rod-shaped edge 4, i.e. is pushed onto the condition shown in the drawing, contacts with edge 4, and is locked by interlocking in the two shanks of the fork 6. In the illustrated embodiment, the function of locking is carried out not by cams but by said spring clip 8.

In result, by using rods 2 with the connecting members 3 according to this invention and/or the proposed joint 1, lattices of two or three dimensional structures are obtained with which, on account of the optionally adjustable connecting angle between joint 1 and rod 2, freely optional constructional heights may be produced and realized using one and the same joint, whereby, especially in the case where connecting member 3 according to this invention is used, the connection between rod 2 and joint 1 is simple to manufacture.

I claim:

1. A lattice, comprising:

a plurality of joints having a polygonal shape, said joints being a hollow body with rounded edges and forming a portion of a plurality of corners of said lattice;

a plurality of rods with each of said rods having at, at least, one end thereof a connecting member for connecting said rod with said joint, said connecting member of said rod having a fork, said fork being capable of gripping at least one of said rounded edges of said joints with a longitudinal axis of said fork extending perpendicularly to the axis of said rod; and, means for locking said connecting member to secure said rod with said joint wherein said means for locking includes a spring clip at the end of said rod.

2. A lattice, comprising:

a plurality of rods which are connectable to one another with each rod of said plurality of rods having at, at least, one end a connecting member shaped as a fork, said fork-shaped connecting member for each of said rods having a symmetric axis extending to the rod on which said connecting member is disposed;

a plurality of joints with each of said joints shaped as a multi-dimensional hollow body and having rounded edges with each of said joints being capable of connecting together two of said rods, said plurality of joints forming a portion of a plurality of corners of said lattice; and, means for locking said connecting member to secure one of said rods with one of said joints, wherein said means for locking includes a spring clip at the end of said rod, whereby each of said fork-shaped connecting members encloses and grasps one of said rounded edges of one of said joints, said fork-shaped connecting member being laterally flanked by a corner of said plurality of joints.

3. A lattice, comprising:

a plurality of rods which are connectable to one another with each rod of said plurality of rods having at, at least, one end a connecting member shaped as a fork, said fork-shaped connecting member for each of said rods having a symmetric axis extending to the rod on which said connecting member is disposed;

a plurality of joints with each of said joints shaped as a cubic hollow body and having twelve rounded edges with each of said joints being capable of connecting together two of said rods, said plurality of joints forming a portion of a plurality of corners of said lattice; and, means for locking said connecting member to secure one of said rods with one of said joints, said means for locking including a spring clip at an end of said rod, whereby each of said fork-shaped connecting members encloses and grasps one of said rounded edges of said joints, said fork-shaped connecting member being laterally flanked by a corner of said plurality of joints.

* * * * *